US010654600B2

(12) United States Patent
Leng et al.

(10) Patent No.: US 10,654,600 B2
(45) Date of Patent: May 19, 2020

(54) METHOD FOR PACKING A MATTRESS SPRING BED

(71) Applicant: XIAMEN GRAND-ONE INDUSTRIAL DESIGNS CO., LTD., Xiamen, Fujian (CN)

(72) Inventors: Luhao Leng, Xiamen (CN); Qiang Li, Xiamen (CN)

(73) Assignee: XIAMEN GRAND-ONE INDUSTRIAL DESIGNS CO., LTD., Xiamen (CN)

( * ) Notice: Subject to any disclaimer, the term of this patent is extended or adjusted under 35 U.S.C. 154(b) by 210 days.

(21) Appl. No.: 14/318,362

(22) Filed: Jun. 27, 2014

(65) Prior Publication Data

US 2015/0000229 A1 Jan. 1, 2015

(30) Foreign Application Priority Data

Jun. 28, 2013 (CN) ..... 2013 1 0270029

(51) Int. Cl.
*B65B 25/00* (2006.01)
*B65B 61/24* (2006.01)
(Continued)

(52) U.S. Cl.
CPC ..... *B65B 13/20* (2013.01); *B65B 5/045* (2013.01); *B65B 31/00* (2013.01); *B65B 31/04* (2013.01);
(Continued)

(58) Field of Classification Search
CPC ..... B65B 31/00; B65B 31/04; B65B 61/24; B65B 5/045; B65B 13/20; B65B 7/00;
(Continued)

(56) References Cited

U.S. PATENT DOCUMENTS 1,748,666 A * 2/1930 Bednarek ..... A47C 27/07 5/267
1,887,226 A * 11/1932 Wunderlich ..... B30B 7/04 100/226
(Continued)

FOREIGN PATENT DOCUMENTS

CN 1317434 A 10/2001
CN 2523299 Y 12/2002
(Continued)

OTHER PUBLICATIONS

European Patent Office, Search Report, dated Sep. 4, 2014.

*Primary Examiner* — Praachi M Pathak
(74) *Attorney, Agent, or Firm* — Cooper Legal Group, LLC

(57) ABSTRACT

A method for packing a mattress spring bed includes: A. overlaying at least two mattress spring beds onto each other to form a mattress spring bed stack, the top side and the bottom side of the mattress spring bed stack are a mattress frame or a rigid support frame; B. placing the mattress spring bed stack into a sealing bag, then vacuuming the sealing bag, resulting in the springs of the spring beds being compressed; C. binding the mattress spring bed stack by strap. The mattress spring bed stack has a small volume, thus reducing the occupied space, increasing the transportation efficiency, and effectively reducing manufacture cost. In addition, the top side and the bottom side of the spring bed stack are respectively a mattress frame or a rigid supporting frame.

7 Claims, 6 Drawing Sheets

(51) Int. Cl.
*B65B 13/20* (2006.01)
*B65B 31/04* (2006.01)
*B65B 5/04* (2006.01)
*B65B 31/00* (2006.01)
*B65B 63/02* (2006.01)

(52) U.S. Cl.
CPC ..... *B65B 61/24* (2013.01); *B65B 25/00* (2013.01); *B65B 63/02* (2013.01)

(58) Field of Classification Search
CPC ..... B65B 31/048; B65B 35/50; A47C 27/04; A47C 23/05; B68G 7/051; Y10T 29/34; Y10T 29/481; Y10T 29/486
USPC ..... 53/399, 434, 436, 447, 582, 512, 523, 53/526, 527, 528, 432; 5/691, 716; 206/524.8, 576; 29/21.1, 91.1, 91.5
See application file for complete search history.

(56) References Cited

U.S. PATENT DOCUMENTS 2,309,795 A * 2/1943 Siegel ..... B65D 85/07 221/63
2,480,158 A * 8/1949 Owen ..... A47C 27/0453 267/91
2,646,580 A * 7/1953 Marsico ..... A47C 23/05 5/401
2,992,443 A * 7/1961 Winikoff ..... A47C 23/0431 5/248
3,246,443 A * 4/1966 Slemmons ..... B65B 63/02 53/436
3,325,831 A * 6/1967 Crosby ..... A47C 27/066 5/260
3,458,966 A * 8/1969 Hullhorst ..... B65B 63/028 53/430
3,516,217 A * 6/1970 Gildersleeve ..... B65D 31/14 53/399
3,611,524 A * 10/1971 Broyles ..... B68G 7/051 29/21.1
3,992,732 A * 11/1976 Cervisi ..... A47C 23/05 5/263
4,069,643 A * 1/1978 Young ..... B65B 9/026 53/434
4,357,724 A * 11/1982 Laforest ..... A47C 23/047 297/DIG. 3
4,418,514 A * 12/1983 Spann ..... B65B 31/00 206/524.8
4,476,595 A * 10/1984 Ikeda ..... A47C 27/0456 267/94
4,620,336 A * 11/1986 Miller ..... A47C 23/005 5/249
4,625,349 A * 12/1986 Higgins ..... B21F 33/04 5/248
4,711,067 A * 12/1987 Magni ..... B65B 63/02 53/116
4,799,350 A * 1/1989 Rias ..... B65B 53/00 53/399
4,817,365 A * 4/1989 Yawberg ..... B65B 63/02 53/434
4,821,491 A * 4/1989 Rias ..... B65B 53/00 53/438
4,928,337 A * 5/1990 Chauncey ..... A47C 27/001 5/722
5,271,498 A 12/1993 Gillespie
5,445,275 A * 8/1995 Curley ..... B65B 31/00 206/525
5,551,104 A * 9/1996 Hartline ..... A47C 17/22 5/13
5,558,315 A * 9/1996 Constantinescu ..... A47C 23/02 267/103
5,979,145 A * 11/1999 Louis ..... B65B 63/022 53/439
6,098,378 A * 8/2000 Wyatt ..... B65B 63/026 53/118
6,101,718 A * 8/2000 Zysman ..... A47C 27/04 29/402.05
6,178,723 B1 * 1/2001 Mossbeck ..... B65B 9/02 53/450
6,186,483 B1 * 2/2001 Bullard ..... A47C 27/063 267/89
6,263,533 B1 * 7/2001 Dimitry ..... A47C 27/066 5/717
6,295,674 B1 * 10/2001 Smith-McKelvey ..... A47C 17/04 5/659
6,298,510 B1 * 10/2001 Mossbeck ..... B65B 9/02 29/91.1
6,321,511 B1 * 11/2001 O'Connor ..... B65B 63/04 206/494
6,739,107 B1 * 5/2004 Lewis ..... B65B 63/024 242/541.5
6,901,722 B2 * 6/2005 Dextraze ..... B65B 31/06 206/223
6,931,685 B2 * 8/2005 Kuchel ..... A47C 23/002 5/716
7,146,779 B2 * 12/2006 Swiszcz ..... E04B 9/0457 53/438
7,210,181 B1 * 5/2007 Price ..... A47C 23/02 267/162
7,376,988 B2 * 5/2008 Wickstrom ..... A47C 23/005 5/12.2
7,383,676 B1 * 6/2008 Schmidt ..... B65B 9/026 53/374.8
7,409,813 B2 * 8/2008 Qi ..... B65B 63/026 100/215
7,458,193 B2 * 12/2008 Andria ..... B65B 13/20 53/399
7,690,096 B1 * 4/2010 Gladney ..... A47C 27/148 29/428
7,823,368 B2 * 11/2010 Hansen ..... B65B 63/02 53/510
7,870,960 B2 * 1/2011 DiLiberto ..... B65B 5/045 206/524.8
8,347,588 B2 * 1/2013 Oh ..... A47C 19/021 5/620
8,984,689 B1 * 3/2015 Hsu ..... A47C 23/0515 5/659
9,095,221 B1 * 8/2015 Tiffany ..... A47C 17/04
9,102,459 B2 * 8/2015 Milican ..... B65D 75/38
9,278,777 B2 * 3/2016 Andria ..... B65B 13/20
9,675,351 B2 * 6/2017 Hodgkinson ..... A61B 17/072
9,756,951 B1 * 9/2017 Stewart, Jr. ..... A47C 19/12
10,010,188 B2 * 7/2018 Hsu ..... A47C 27/061
10,239,657 B2 * 3/2019 Andria ..... B65B 13/20
2002/0046550 A1 * 4/2002 O'Connor ..... B65B 63/04 53/429
2002/0157353 A1 * 10/2002 Smithson ..... B65B 31/06 53/434
2003/0028963 A1 * 2/2003 McCraw ..... A47C 23/06 5/246
2003/0183550 A1 * 10/2003 DiLiberto, Jr. ..... B65B 63/02 206/524.8
2005/0034243 A1 * 2/2005 Carlitz ..... A47C 23/05 5/716
2005/0050640 A1 * 3/2005 Ahn ..... A47C 27/05
2005/0166329 A1 * 8/2005 Carlitz ..... A47C 23/0431 5/721
2007/0221532 A1 * 9/2007 DiLiberto ..... B65B 63/02 206/524.8
2007/0277479 A1 * 12/2007 Hansen ..... B65B 63/02 53/436
2008/0086984 A1 * 4/2008 Andria ..... B65B 13/20 53/434
2008/0098533 A1 * 5/2008 Erdman ..... A47C 27/001 5/722
2008/0245690 A1 * 10/2008 Knewtson ..... B65B 13/02 206/326

(56) References Cited

U.S. PATENT DOCUMENTS

| | | | | |
|---|---|---|---|---|
| 2008/0284071 | A1* | 11/2008 | Knewtson | B65B 13/02 267/91 |
| 2009/0293431 | A1* | 12/2009 | Andria | B65B 5/045 53/438 |
| 2011/0167558 | A1* | 7/2011 | Harris | A47C 17/175 5/18.1 |
| 2011/0266188 | A1* | 11/2011 | Share | B65B 9/08 206/524.8 |
| 2012/0102884 | A1* | 5/2012 | Roberts, Jr. | B29C 44/18 53/436 |
| 2012/0272457 | A1* | 11/2012 | Allman | A47C 27/15 5/716 |
| 2015/0000229 | A1* | 1/2015 | Leng | B65B 13/20 53/410 |
| 2016/0318680 | A1* | 11/2016 | Zerial | B65D 85/08 |
| 2018/0228296 | A1* | 8/2018 | Miller | A47C 23/005 |

FOREIGN PATENT DOCUMENTS

| | | | |
|---|---|---|---|
| CN | 1583517 | A | 2/2005 |
| CN | 2721527 | Y | 8/2005 |
| CN | 101081648 | A | 12/2007 |
| CN | 101397056 | A | 4/2009 |
| CN | 101898645 | A | 12/2010 |
| CN | 102079391 | A | 6/2011 |
| EP | 0072302 | A1 | 2/1983 |
| FR | 2216811 | A5 | 8/1974 |
| JP | 2005198899 | A | 7/2005 |

* cited by examiner

METHOD FOR PACKING A MATTRESS SPRING BED

CROSS-REFERENCE TO RELATED APPLICATION

This non-provisional application claims priority under 35 U.S.C. § 119(a) on Patent Application No. 201310270029.7 filed in P.R. of China on Jun. 28, 2013, the entire contents of which are hereby incorporated by reference.

FIELD OF THE INVENTION

The present invention relates to a method for packing a mattress spring bed.

BACKGROUND OF THE INVENTION

A mattress comprises springs, a mattress frame, sponge and cloth. The springs are fastened to the mattress frame. The sponge is disposed on the frame and surrounded by cloth. The mattress is large in size, making it inconvenient to transport. Therefore mattresses are generally sold in a local production area. To reduce transportation volume, the existing method includes packing soft parts such as springs, sponge and cloth and rigid parts such as mattress frames separately. The soft parts are compressed to reduce the volume. Other parts such as mattress frames are packed and transported separately. The soft parts and the rigid parts need to be reassembled after arrival, to produce a mattress, thus increases work. In addition, the compressed springs are under stress and may present a safety risk.

SUMMARY OF THE INVENTION

The present invention provides a method for packing a mattress spring bed, the method effectively reduces transportation and manufacture cost of mattresses. The technical solution of the present invention to solve the technical problems is:

A method for packing a mattress spring bed, the mattress spring bed comprising springs and a mattress frame, the method comprising:

A. overlaying at least two mattress spring beds onto each other to form a mattress spring bed stack, the top side and the bottom side of the mattress spring bed stack are mattress frames or a rigid support frame;

B. placing the mattress spring bed stack into a sealing bag; vacuuming the sealing bag, resulting in the springs of the mattress spring beds being compressed; and C. binding the mattress spring bed stack using a strap.

The mattress spring bed stack has a smaller volume, thus reducing the occupied space and enhancing the transportation efficiency, and effectively reducing manufacturing cost. In addition, the top side and the bottom side of the mattress spring bed stack are respectively a mattress frame of a mattress or a rigid supporting frame, therefore, the strap can effectively bind the mattress spring bed stack, preventing deformation of the mattress spring bed stack. Furthermore, as the mattress spring bed stack is sealed by a sealing bag and bound by a strap, when disassembling the mattress spring bed stack, after the strap is cut, the sealing bag causes the springs to release slowly, without the help of a machine, thus effectively providing personal safety to the workers.

In one preferred embodiment, in step B, the method further comprises compressing the mattress spring bed stack by a compressor, so that springs of the mattress spring beds are compressed, before vacuuming the sealing bag. This ensures the uniformity of the mattress spring bed stack and enhances the vacuuming efficiency.

In another preferred embodiment, in two adjacent spring beds, springs of one mattress face springs of the other mattress, or the mattress frame of one mattress abuts the mattress frame of the other mattress. This ensures the uniformity of the mattress spring bed stack.

In another preferred embodiment, in step B, after the springs of the mattresses are compressed, the thickness of the compressed mattress spring bed stack is decreased to 25%-35% of the original thickness of the uncompressed mattress spring bed stack.

A method for packing a mattress, wherein the mattress comprises springs and a mattress frame, the springs and the mattress frame are detachable, the method comprising:

A. overlaying springs of at least two mattresses onto each other to form a spring stack;

B. placing the spring stack into the sealing bag, vacuuming the sealing bag, resulting in the spring stack being compressed;

C. using the mattress frames of the mattress spring beds to hold the compressed spring stack, resulting in a mattress spring bed stack, the top side and the bottom side of the mattress spring bed stack are respectively a mattress frame of the mattress spring bed or a rigid supporting frame; and D. binding the mattress spring bed stack by a strap.

Advantageously, the spring stack has a small volume, thus reducing the occupied space and enhancing the transportation efficiency, and effectively reducing the manufacture cost. In addition, the top side and the bottom side of the mattress spring bed stack are respectively a mattress frame of a mattress spring bed or a rigid supporting frame, therefore, the strap can effectively bind the mattress spring bed stack, preventing deformation of the mattress spring bed stack. In addition, as the mattress spring bed stack is sealed by a sealing bag and bound by a strap, when disassembling the mattress spring bed stack, after the strap is cut, the sealing bag causes the springs stack to release slowly, without the help of a machine, thus effectively providing personal safety.

In another preferred embodiment, in step B, the method further comprises compressing the spring stack by a compressor, so that the spring stack is compressed, before vacuuming the sealing bag. This ensures the uniformity of the mattress spring bed stack and enhances the vacuuming efficiency.

In another preferred embodiment, in step B, the thickness of the compressed spring stack is decreased to 15%-25% of the original thickness of the uncompressed spring stack.

BRIEF DESCRIPTION OF THE DRAWINGS

The present invention will be further described with the drawings and the embodiments.

DETAILED DESCRIPTION OF THE EMBODIMENTS

First Embodiment

Figure 1:
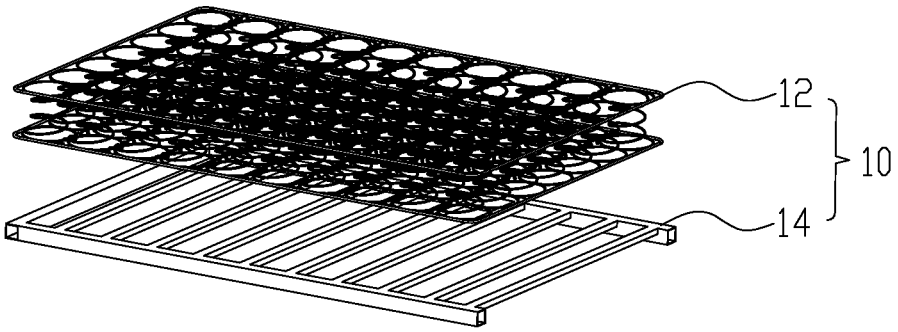
FIG. 1 illustrates an exploded diagram of a mattress spring bed of the present invention.
Figure 2:
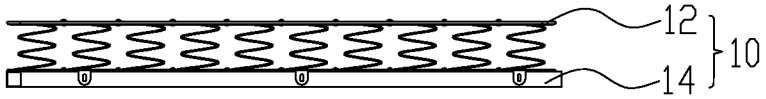
FIG. 2 illustrates a front view of the mattress spring bed in FIG. 1.

Referring to FIGS. 1 and 2, a mattress spring bed 10 of the present invention comprises springs 12 and a mattress frame 14. The springs 12 are connected to the mattress frame 14. The springs 12 are detachably fastened to the mattress frame 14. The mattress frame 14 is a bed board made of rigid material, for example, wood or iron.

Figure 4:
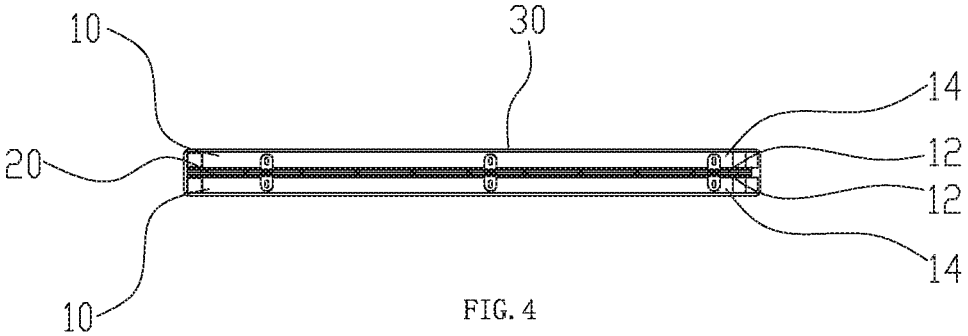
FIG. 4 illustrates a front view of a compressed mattress spring bed stack according to the first embodiment.

Referring to FIGS. 3 to 6, in accordance with a first embodiment, a method for packing a mattress comprises the steps of:

A. overlaying two mattress spring beds 10 on to each other to form a mattress spring bed stack 20. The top side and the bottom side of the mattress spring bed stack 20 are the respective mattress frames 14 of the two mattress spring beds 10. The sides with the springs 12 of both mattress spring beds abut together (as illustrated in FIG. 3);

B. placing the mattress spring bed stack 20 into a sealing bag 30, then vacuuming 100 the sealing bag 30, resulting in the springs 12 of the mattress spring beds 10 becoming compressed (as illustrated in FIG. 4);

in step B, before vacuuming 100, a compressor may be used, for example a pair of press boards, to hold and compress the mattress spring bed stack 20, so that the springs 12 of the mattress spring beds 10 are compressed. Vacuuming 100 the sealing bag 30 under this compressed condition ensures the uniformity of the mattress spring bed stack 20 and enhances the vacuuming efficiency.

Figure 3:
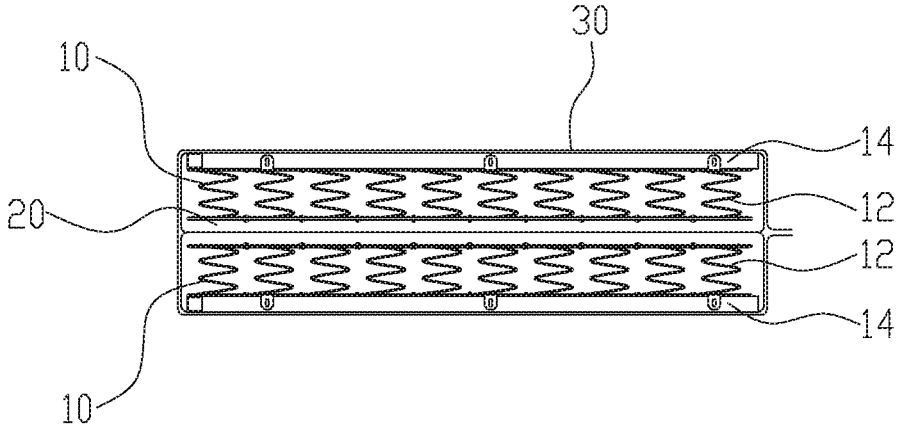
FIG. 3 illustrates a front view of an uncompressed mattress spring bed stack according to a first embodiment.
Figure 5:
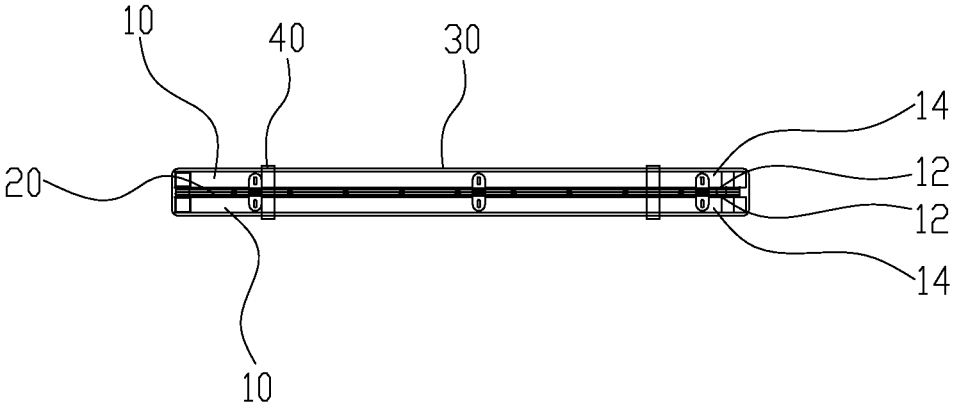
FIG. 5 illustrates a front view of a strap bound mattress spring bed stack according to the first embodiment.
Figure 6:
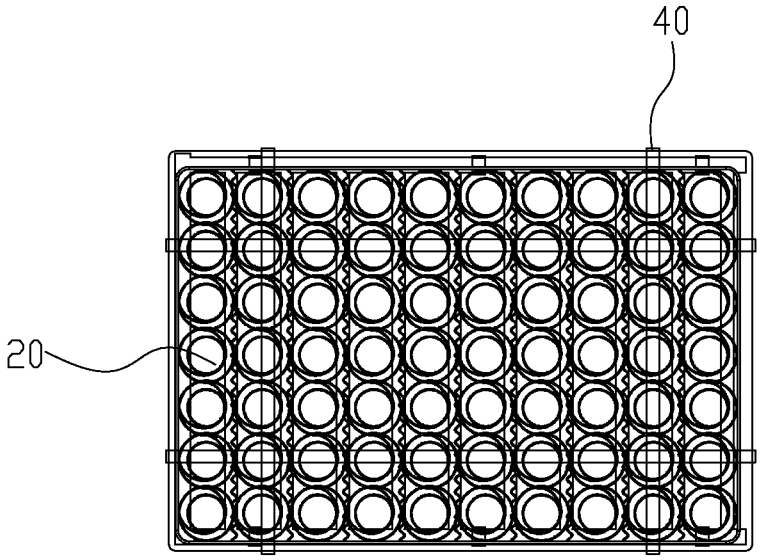
FIG. 6 illustrates a top view of a strap bound mattress spring bed stack according to the first embodiment.

After the springs 12 of the mattress spring beds 10 are compressed, the thickness of the compressed mattress spring bed stack 20 (as illustrated in FIG. 4) is generally reduced to 25%-35% of the original thickness of the uncompressed mattress spring bed stack 20 (as illustrated in FIG. 3); and C. binding the mattress spring bed stack 20 using strap 40 (as illustrated in FIG. 5). The strap 40 may bind the mattress spring bed stack 20 in a pattern of two parallel straps in traverse direction and two parallel straps in longitudinal direction, as illustrated in FIG. 6. It should be apparent to a person skilled in the art that the straps 40 can bind the mattress spring bed stack 20 with more than two straps in each direction resulting in a net pattern.

The number of the mattress spring beds 10 may be an even number, in two adjacent mattress spring beds 10, the side of the springs 12 of one mattress spring bed 10 faces the side of the springs 12 of a second mattress spring bed 10. Alternatively, the mattress frame 14 of one mattress spring bed 10 abuts the mattress frame 14 of a second mattress spring bed 10. Both arrangements, i.e mattress frames 14 sides facing each other or the springs sides facing each other, provide greater smoothness, and rigid support to surround the soft springs.

The number of the mattress spring beds 10 may also be 3, 5 and so on. The top side and the bottom side of the mattress spring bed stack 20 may be a mattress frame 14 or a rigid supporting board, in both cases the strap 40 can bind the mattress spring bed stack 20 effectively, so that soft cushions are placed inside the rigid supporting frames, thus preventing damage.

It should be apparent to a person skilled in the art that the springs 12 of the mattress spring bed 10 and the mattress frames 14 can be an inseparable unitary structure.

Figure 11:
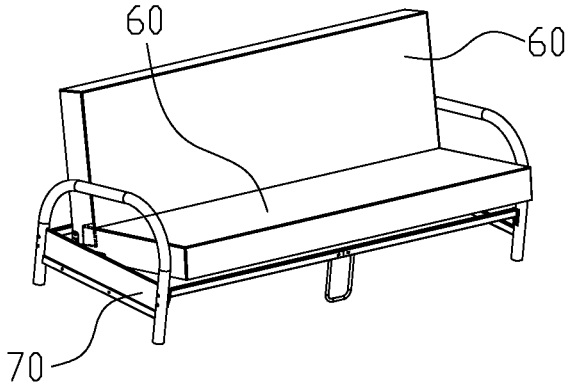
FIG. 11 illustrates a schematic diagram of a sofa assembled with a mattress spring bed of the present invention.

Referring to FIG. 1, FIG. 2 and FIG. 11, using a cloth cover 60 to wrap the mattress spring bed 10, padding the interior with sponge, placing on a supporting frame 70, the mattress frame 14 is served as a bed board, the mattress spring bed 10 can be assembled as a sofa bed.

Second Embodiment

Figure 7:
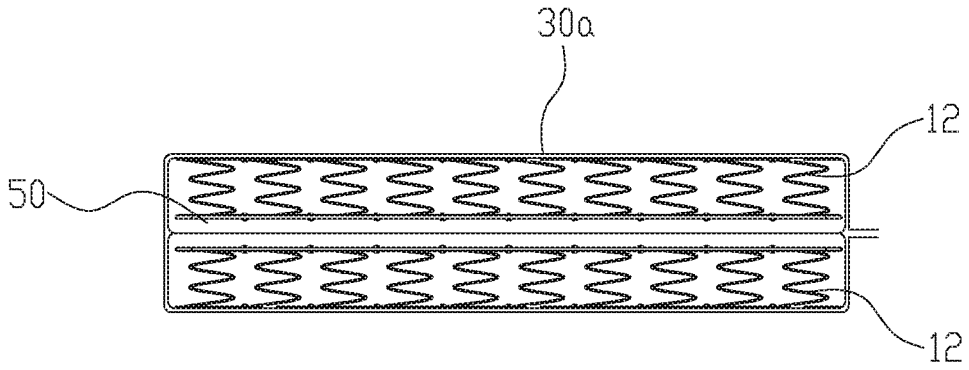
FIG. 7 illustrates a front view of a uncompressed spring stack according to a second embodiment.
Figure 8:
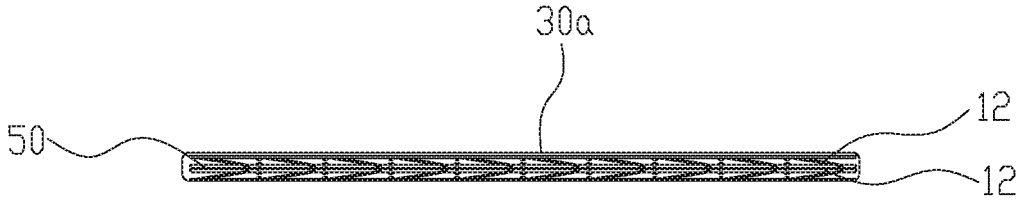
FIG. 8 illustrates a front view of a compressed spring stack according to the second embodiment.

Referring to FIG. 7 to FIG. 10, in accordance with a second embodiment, a method for packing mattress springs, in which the springs 12 and the mattress frame 14 of a mattress spring bed 10 are separable, comprising the steps of:

A. overlaying the springs 12 of two mattress spring beds 10 on to each other to form a spring stack 50 (as illustrated in FIG. 7);

B. placing the spring stack 50 into the sealing bag 30*a*, then vacuuming 100 the sealing bag 30*a*, resulting in the spring stack 50 being compressed (as illustrated in FIG. 8);

Preferably, in step B, a compressor may be used, for example a pair of press boards to hold and compress the spring stack 50, so that the spring stack 50 is compressed. Vacuuming 100 the sealing bag 30*a* under this compressed condition ensures the uniformity of the spring stack 50 and the efficiency of vacuuming 100.

Preferably, in step B, the thickness of the compressed spring stack 50 is decreased to 15%-25% of the original thickness of the spring stack 50.

Figure 9:
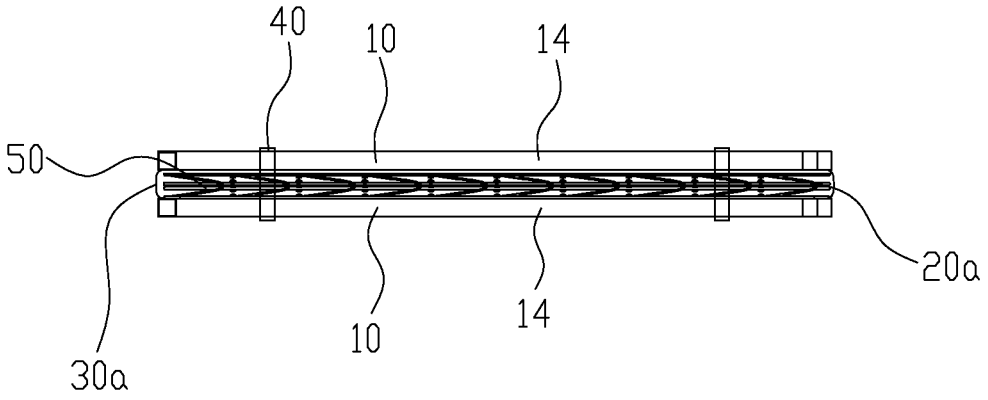
FIG. 9 illustrates a front view of a strap bound mattress spring bed stack according to the second embodiment.
Figure 10:
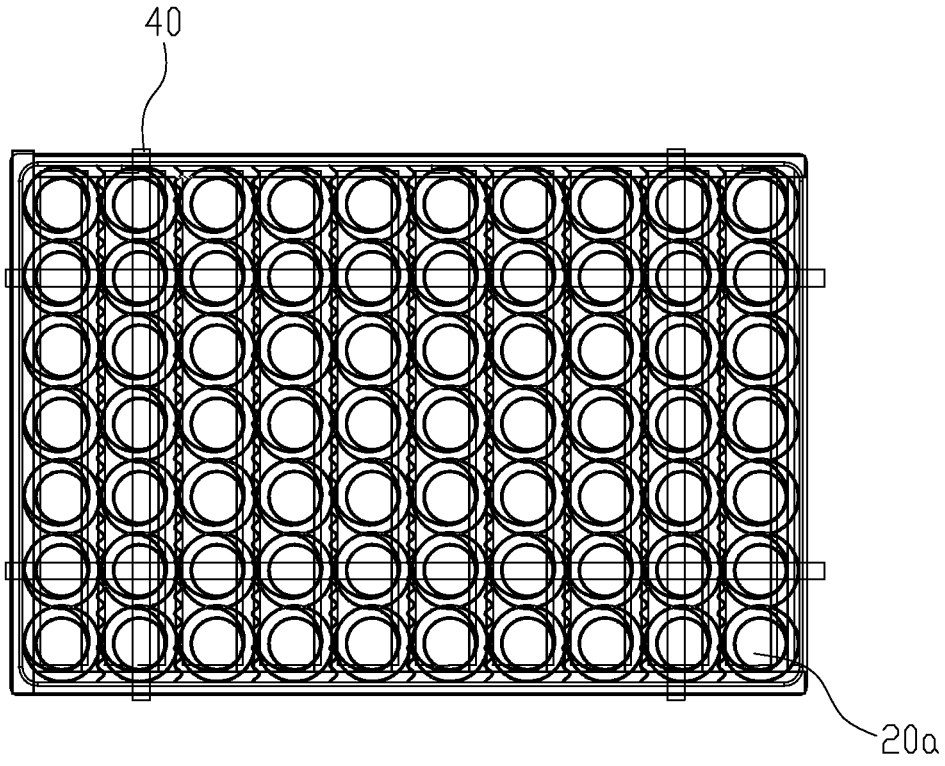
FIG. 10 illustrates a top view of a strap bound mattress spring bed stack according to the second embodiment.

C. using frames 14 of the mattress spring beds 10 to hold the compressed spring stack 50, resulting in a mattress spring bed stack 20*a*. The top side and the bottom side of the mattress spring bed stack 20*a* are the respective mattress frame 14 of two mattress spring bed 10 (as illustrated in FIG. 9); and D. binding the mattress spring bed stack 20*a* by strap 40. The strap 40 binds the mattress spring bed stack 20*a* in a pattern of two parallel straps in traverse direction and two parallel straps in longitudinal direction (as illustrated in FIG. 10).

It should be apparent to a person skilled in the art that the number of the mattress spring beds 10 are not limited, only if the top side and the bottom side of the mattress spring bed stack 20*a* are mattress frames 14 or rigid supporting frames, the strap 40 can effectively bind the mattress spring bed stack 20*a*.

Figure 12:
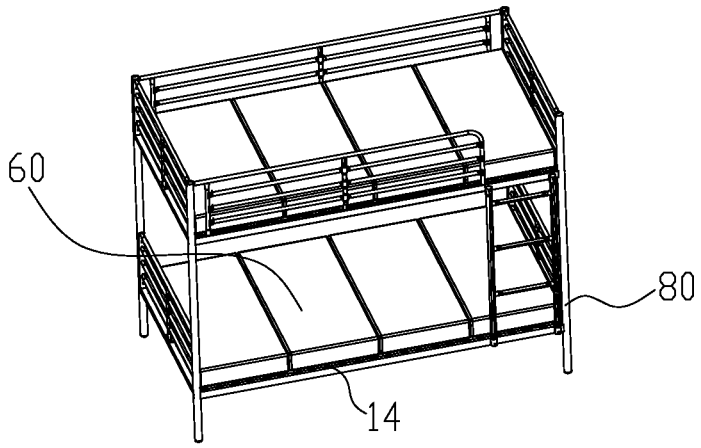
FIG. 12 illustrates a schematic diagram of an iron bed assembled with a mattress spring bed of the present invention.

Referring to FIG. 1, FIG. 2 and FIG. 12, using a cloth cover 60 to wrap springs 12 of the mattress spring bed 10, padding the interior with sponge, the springs 12 are then covered by a cloth cover 60, placed on a mattress frame 14, with a frame 80, and assembled to an iron bed with a mattress spring bed.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

What is claimed is:

1. A method for packing mattress spring beds, the method comprising:

assembling two uncompressed mattress spring beds, each of the two uncompressed mattress spring beds comprising a mattress frame, connecting a first end of a plurality of springs together and a second end of the plurality of springs together to form a spring assembly for each of the two uncompressed mattress spring beds, detachably fastening the spring assembly to each of the mattress frames of each of the two uncompressed mattress spring beds, disposing a sponge layer on the mattress frame of each of the two uncompressed mattress spring beds, and surrounding the sponge layer with cloth;

overlaying the assembled two uncompressed mattress spring beds onto each other to form a mattress spring bed stack, such that the mattress frame of a first of the two uncompressed mattress spring beds is spaced apart from the mattress frame of a second of the two uncompressed mattress spring beds by positioning the spring assembly of the first uncompressed mattress spring bed in abutment with the spring assembly of the second uncompressed mattress spring bed, such that a top end of the mattress spring bed stack is the mattress frame of the first uncompressed mattress spring bed and a bottom end of the mattress spring bed stack is the mattress frame of the second uncompressed mattress spring bed;

placing the mattress spring bed stack into a sealing bag;

mechanically compressing the mattress spring bed stack within the sealing bag, resulting in the spring assemblies in each of the two uncompressed mattress spring beds being compressed;

vacuum compressing the mechanically compressed mattress spring bed stack in the sealing bag resulting in the spring assemblies in each of the two mechanically compressed mattress spring beds being further compressed;

sealing the vacuum compressed mattress spring bed stack within the sealing bag; and binding the vacuum compressed mattress spring bed stack in the sealed sealing bag using a strap.

2. The method according to claim 1, wherein the mattress frame of each of the two uncompressed mattress spring beds is a bed board.

3. The method according to claim 1, wherein the mattress frame of each of the two uncompressed mattress spring beds comprises a side supporting frame.

4. The method according to claim 1, wherein a thickness of the mattress spring bed stack after mechanically compressing the mattress spring bed stack and vacuum compressing the sealing bag is 25%-35% of an original thickness of the mattress spring bed stack before mechanically compressing the mattress spring bed stack and vacuum compressing the sealing bag.

5. The method according to claim 1, wherein the cloth surrounding the sponge layer of the first uncompressed mattress spring bed abuts the cloth surrounding the sponge layer of the second uncompressed mattress spring bed.

6. The method according to claim 1, wherein each of the two uncompressed mattress spring beds comprises only one mattress frame.

7. The method according to claim 6, wherein the mattress frame of each of the two uncompressed mattress spring beds is at least one of wood or iron.

* * * * *